US008965230B2

(12) United States Patent
Yamashina et al.

(10) Patent No.: US 8,965,230 B2
(45) Date of Patent: Feb. 24, 2015

(54) FIXING DEVICE

(71) Applicants: Ryota Yamashina, Kanagawa (JP); Hiroshi Seo, Kanagawa (JP); Ippei Fujimoto, Kanagawa (JP); Takumi Waida, Tokyo (JP)

(72) Inventors: Ryota Yamashina, Kanagawa (JP); Hiroshi Seo, Kanagawa (JP); Ippei Fujimoto, Kanagawa (JP); Takumi Waida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 80 days.

(21) Appl. No.: 13/753,827

(22) Filed: Jan. 30, 2013

(65) Prior Publication Data

US 2013/0209122 A1 Aug. 15, 2013

(30) Foreign Application Priority Data

Feb. 9, 2012 (JP) ..... 2012-026051
Jun. 8, 2012 (JP) ..... 2012-130734

(51) Int. Cl.
*G03G 15/20* (2006.01)

(52) U.S. Cl.
CPC ..... *G03G 15/205* (2013.01); *G03G 2215/2029* (2013.01)
USPC ..... 399/68; 399/67; 399/69; 399/328; 399/400; 219/216

(58) Field of Classification Search
USPC ..... 399/67, 68, 69, 33, 122, 320, 328, 332, 399/400; 219/216
See application file for complete search history.

(56) References Cited

U.S. PATENT DOCUMENTS

| | | | | |
|---|---|---|---|---|
| 6,246,843 | B1 * | 6/2001 | Nanataki et al. | 399/45 |
| 8,150,289 | B2 | 4/2012 | Yamashina et al. | |
| 2006/0002745 | A1 | 1/2006 | Iwasaki | |
| 2006/0165443 | A1 | 7/2006 | Yoshinaga et al. | |
| 2006/0177232 | A1 | 8/2006 | Ehara et al. | |
| 2007/0003334 | A1 | 1/2007 | Shinshi et al. | |

(Continued)

FOREIGN PATENT DOCUMENTS

| | | |
|---|---|---|
| JP | 2002-049264 | 2/2002 |
| JP | 2004-198535 | 7/2004 |

(Continued)

OTHER PUBLICATIONS

U.S. Appl. No. 13/557,841, filed Jul. 25, 2012, Toshihiko Shimokawa et al.

(Continued)

*Primary Examiner* — Francis Gray
(74) *Attorney, Agent, or Firm* — Oblon, Spivak, McClelland, Maier & Neustadt, L.L.P.

(57) ABSTRACT

A fixing device includes a rotatable fuser member, a rotatable pressure member, a heater, and a controller. The rotatable fuser member is subjected to heating. The rotatable pressure member is disposed opposite the fuser member. The pressure member presses against the fuser member to form a fixing nip therebetween, through which multiple recording media, each spaced apart from each other by an interval distance in a conveyance direction, are sequentially conveyed at a conveyance speed. The heater is disposed adjacent to the fuser member to heat the fuser member. The controller is operatively connected to the heater to control power supply to the heater through a series of on-off switching control cycles, each including an on-time during which the heater power supply is on, and an off-time during which the heater power supply is off, in synchronization with conveyance of the recording medium.

16 Claims, 10 Drawing Sheets

(56) References Cited

U.S. PATENT DOCUMENTS

2007/0059003 A1 3/2007 Shinshi et al.
2007/0059011 A1 3/2007 Seo et al.
2007/0212089 A1 9/2007 Seo et al.
2007/0242988 A1 10/2007 Seo et al.
2007/0280754 A1 12/2007 Ogawa et al.
2008/0025772 A1 1/2008 Seo et al.
2008/0025773 A1 1/2008 Ito et al.
2008/0044196 A1 2/2008 Seo et al.
2008/0219721 A1 9/2008 Ito et al.
2008/0226326 A1 9/2008 Seo et al.
2008/0232873 A1 9/2008 Ueno et al.
2008/0253789 A1 10/2008 Yoshinaga et al.
2009/0003867 A1 1/2009 Fujimoto
2009/0060550 A1 3/2009 Seo
2009/0074442 A1 3/2009 Sano et al.
2009/0148205 A1 6/2009 Seo et al.
2009/0169232 A1 7/2009 Kunii et al.
2009/0245897 A1 10/2009 Seo et al.
2009/0290893 A1* 11/2009 Ogiso et al. ..... 399/69
2009/0290894 A1* 11/2009 Iwata ..... 399/69
2010/0061754 A1* 3/2010 Ishigaya et al. ..... 399/70
2010/0092220 A1 4/2010 Hasegawa et al.
2010/0092221 A1 4/2010 Shinshi et al.
2010/0290822 A1 11/2010 Hasegawa et al.
2010/0303521 A1 12/2010 Ogawa et al.
2011/0026988 A1 2/2011 Yoshikawa et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0064502 A1 3/2011 Hase et al.
2011/0076071 A1 3/2011 Yamaguchi et al.
2011/0085832 A1 4/2011 Hasegawa et al.
2011/0091226 A1 4/2011 Ishigaya et al.
2011/0091253 A1 4/2011 Seo et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206402 A1 8/2011 Yamashina
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222926 A1 9/2011 Ueno et al.
2011/0222927 A1 9/2011 Yamashina
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0274453 A1 11/2011 Shimokawa et al.
2011/0311284 A1 12/2011 Seo et al.
2012/0007571 A1* 1/2012 Huisman ..... 323/271
2012/0051774 A1 3/2012 Ikebuchi et al.
2012/0093532 A1 4/2012 Ishigaya et al.
2012/0093534 A1 4/2012 Waida et al.
2012/0114345 A1 5/2012 Fujimoto et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0201547 A1 8/2012 Yamashina
2012/0207502 A1 8/2012 Seo
2012/0219312 A1 8/2012 Yuasa et al.
2012/0224878 A1* 9/2012 Ikebuchi et al. ..... 399/70
2012/0237273 A1 9/2012 Yoshinaga et al.
2012/0243895 A1 9/2012 Samei et al.
2012/0301161 A1 11/2012 Fujimoto
2013/0045032 A1* 2/2013 Shimokawa et al. ..... 399/329
2013/0209122 A1* 8/2013 Yamashina et al. ..... 399/68
2013/0209123 A1* 8/2013 Waida et al. ..... 399/68
2013/0209124 A1* 8/2013 Saito et al. ..... 399/69

FOREIGN PATENT DOCUMENTS

JP 2006-047990 2/2006
JP 2008-070686 3/2008
JP 2009-069623 4/2009
JP 2009-282162 12/2009

OTHER PUBLICATIONS

U.S. Appl. No. 13/716,651, filed Dec. 17, 2012, Saito et al.
U.S. Appl. No. 13/749,164, filed Jan. 24, 2013, Waida et al.
U.S. Appl. No. 13/755,439, filed Jan. 31, 2013, Seo et al.
U.S. Appl. No. 13/761,848, filed Feb. 7, 2013, Waida et al.
U.S. Appl. No. 13/753,827, filed Jan. 30, 2013, Yamashina et al.
U.S. Appl. No. 13/763,047, filed Feb. 8, 2013, Uchitani et al.
U.S. Appl. No. 13/754,305, filed Jan. 30, 2013, Hase et al.

* cited by examiner

TEMPERATURE (°C)
$T_f$
$T_p$
HEATER DUTY
TIME (sec)
$t_0$
$D_i$ $F_1$
$D_i$ $F_2$
$D_i$ $F_3$
$D_i$ $F_4$
$D_i$ $F_5$
$D_i$ $F_6$
$D_i$ $F_7$
$D_i$ $F_8$
$D_i$ $F_9$
$D_i$ $F_{10}$
$D_i$
40 %
24 %
8 %
0 %
30 %
20 %
10 %
36 %
32 %
28 %

FIXING DEVICE

CROSS-REFERENCE TO RELATED APPLICATIONS

The present patent application claims priority pursuant to 35 U.S.C. §119 from Japanese Patent Application Nos. 2012-026051 and 2012-130734, filed on Feb. 9, 2012, and Jun. 8, 2012, respectively, each of which is hereby incorporated by reference herein in its entirety.

BACKGROUND OF THE INVENTION

1. Technical Field

The present invention relates to a fixing device, and more particularly, to a fixing device for use in an image forming apparatus, such as a photocopier, facsimile machine, printer, plotter, or multifunctional machine incorporating several of these features.

2. Background Art

In electrophotographic image forming apparatuses, such as photocopiers, facsimile machines, printers, plotters, or multifunctional machines incorporating several of these features, an image is formed by attracting developer or toner particles to a photoconductive surface for subsequent transfer to a recording medium such as a sheet of paper. After transfer, the imaging process is followed by a fixing process using a fixing device, which permanently fixes the toner image in place on the recording medium with heat and pressure.

In general, a fixing device employed in electrophotographic image formation includes a pair of generally cylindrical looped belts or rollers, one being heated for fusing toner ("fuser member") and the other being pressed against the heated one ("pressure member"), which together form a heated area of contact called a fixing nip. As a recording medium bearing a toner image thereupon enters the fixing nip, heat from the fuser member causes the toner particles to fuse and melt, while pressure between the fuser and pressure members causes the molten toner to set onto the recording medium.

To date, some fixing devices employ a small-sized, thin-walled fixing roller that exhibits an extremely low heat capacity. Although allowing a fast, energy-efficient fixing process that can process a toner image with a short warm-up time and reduced energy consumption, those fixing devices are susceptible to variations in fixing performance due to insufficient heating of the low-heat capacity equipment, from which a substantial amount of heat is dissipated as the recording medium passes through the fixing nip.

To prevent variations in fixing performance, one approach is to design a fuser roller with its circumferential length longer than a shorter edge of a recording sheet accommodated in the fixing device, such as A4-size copy paper. Such arrangement allows the recording sheet to pass through the fixing nip in a shorter period of time than that required for one rotation of the fuser roller, thereby enabling uniform heat distribution from the fuser roller along the length of the recording sheet.

Although generally successful for its intended purposes, the method described above has a limitation in that it cannot effectively prevent variations in fixing performance due to a reduction in the temperature of the pressure member, causing concomitant variations in the temperature along the circumference of the fuser member.

SUMMARY OF THE INVENTION

Exemplary aspects of the present invention are put forward in view of the above-described circumstances, and provide a novel fixing device.

In one exemplary embodiment, the fixing device includes a rotatable fuser member, a rotatable pressure member, a heater, and a controller. The rotatable fuser member is subjected to heating. The rotatable pressure member is disposed opposite the fuser member. The pressure member presses against the fuser member to form a fixing nip therebetween, through which multiple recording media, each spaced apart from each other by an interval distance in a conveyance direction, are sequentially conveyed at a conveyance speed. The heater is disposed adjacent to the fuser member to heat the fuser member. The controller is operatively connected to the heater to control power supply to the heater through a series of on-off switching control cycles, each including an on-time during which the heater power supply is on, and an off-time during which the heater power supply is off, in synchronization with conveyance of the recording medium to satisfy the following equation:

$$T1+T2=C*X$$

where "T1" is a length of media passage time during which each recording medium passes through the fixing nip, "T2" is a length of interval time between two successive recording media exiting and subsequently entering the fixing nip, "C" is a duration of the control cycle of the heater power supply, and "X" is a cycle count being a positive integer. The controller corrects a duty ratio, being a ratio of the on-time relative to a sum of the on-time and the off-time, by adding a positive correction factor decreasing with an increasing number of control cycles performed to the duty ratio. The correction factor is adjustable depending on a variable parameter with which printing is performed.

Other exemplary aspects of the present invention are put forward in view of the above-described circumstances, and provide a novel image forming apparatus incorporating the fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
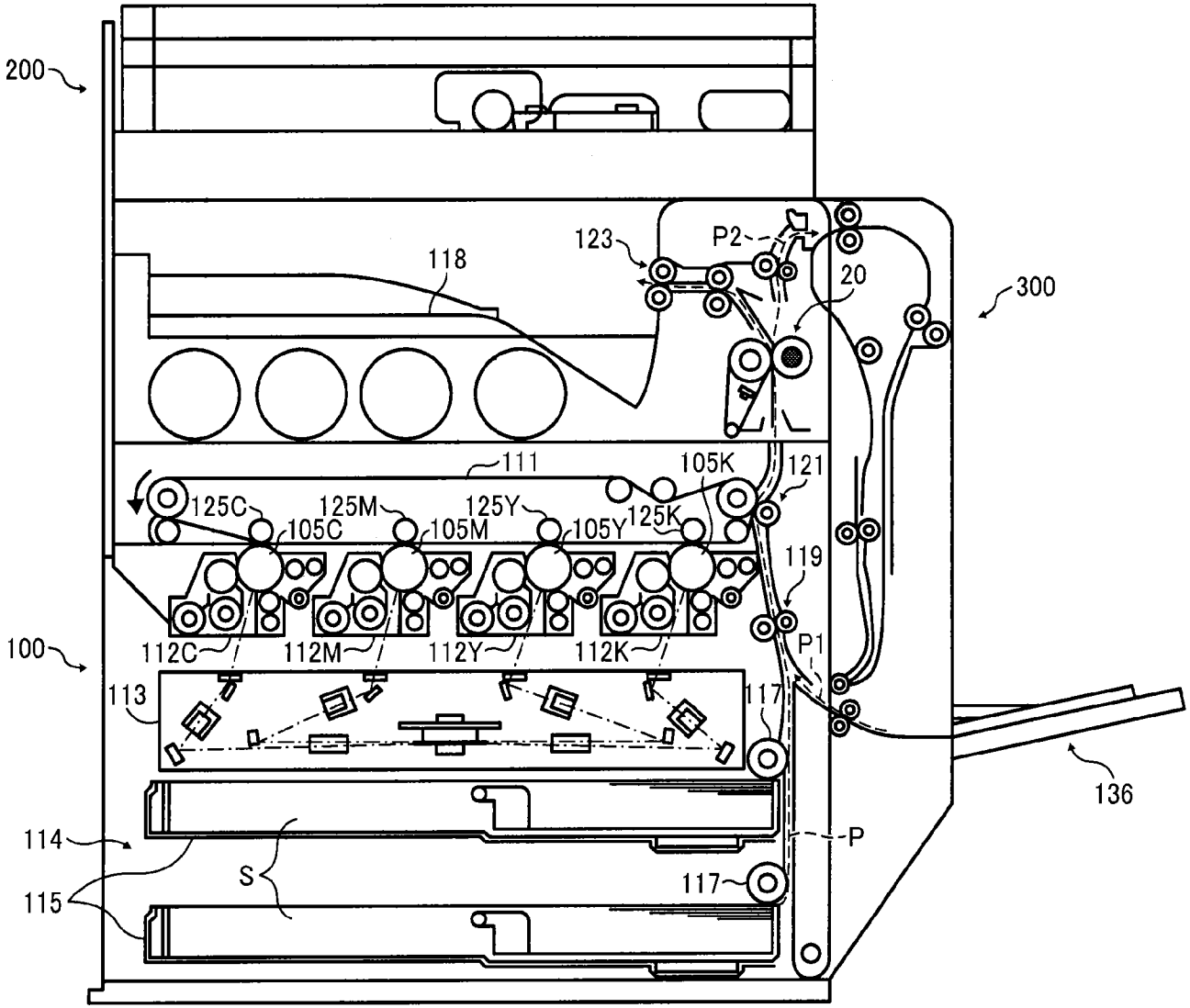
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating a fixing device 20 according to one embodiment of this patent specification.

As shown in FIG. 1, the image forming apparatus 100 is shown configured as an electrophotographic copier provided with an image scanner 200 located atop the apparatus body to capture image data from an original document, as well as a media reversal unit 300 attached to a side of the apparatus body to allow reversing a recording sheet S during duplex printing.

The apparatus 100 comprises a tandem color printer that forms a color image by combining images of yellow, magenta, and cyan (i.e., the complements of three subtractive primary colors) as well as black, consisting of four electrophotographic imaging stations 112C, 112M, 112Y, and 112K arranged in series substantially laterally along the length of an intermediate transfer belt 111, each forming an image with toner particles of a particular primary color, as designated by the suffixes "C" for cyan, "M" for magenta, "Y" for yellow, and "K" for black.

Each imaging station 112 includes a drum-shaped photoconductor 105 rotatable clockwise in the drawing, facing a laser exposure device 113 therebelow, while surrounded by various pieces of imaging equipment, such as a charging device, a development device, a transfer device incorporating an electrically biased, primary transfer roller 125, and a cleaning device for the photoconductive surface, which work in cooperation to form a primary toner image on the photoconductor 105 for subsequent transfer to the intermediate transfer belt 111 at a primary transfer nip defined between the photoconductive drum 105 and the primary transfer roller 125.

The intermediate transfer belt 111 is trained around multiple support rollers to rotate counterclockwise in the drawing, passing through the four primary transfer nips sequentially to carry thereon a multi-color toner image toward a secondary transfer nip defined between a secondary transfer roller 121 and a belt support roller.

Below the exposure device 113 is a sheet supply unit 114 including one or more input sheet trays 115 each accommodating a stack of recording media such as paper sheets S. A feed roller 117 is disposed at one end of each sheet tray 115 to feed the recording sheet S from the sheet stack. The sheet supply unit 114 also includes a pair of registration rollers 119, an output unit formed of a pair of output rollers 123, an in-body, output sheet tray 118 located underneath the image scanner 200, and other guide rollers or plates disposed between the input and output trays 115 and 118.

The sheet supply unit 114 defines a primary, sheet conveyance path P for conveying the recording sheet S from the input tray 115, between the registration rollers 119, then through the secondary transfer nip, then through the fixing device 20, and then between the output rollers 123 to the output tray 118. A pair of secondary, sheet conveyance paths P1 and P2 are also defined in connection with the primary path P, the former for re-introducing a sheet S into the primary path P after processing through the reversal unit 300 or upon input in a manual input tray 136, and the latter for introducing a sheet S from the primary path P into the reversal unit 300 downstream from the fixing device 20.

During operation, the image forming apparatus 100 can perform printing in various print modes, including a monochrome print mode and a full-color print mode, as specified by a user submitting a print job.

In full-color printing, each imaging station 112 rotates the photoconductor drum 105 clockwise in the drawing to forward its outer, photoconductive surface to a series of electrophotographic processes, including charging, exposure, development, transfer, and cleaning, in one rotation of the photoconductor drum 105.

First, the photoconductive surface is uniformly charged by the charging roller and subsequently exposed to a modulated laser beam emitted from the exposure device 113. The laser exposure selectively dissipates the charge on the photoconductive surface to form an electrostatic latent image thereon according to image data representing a particular primary color. Then, the latent image enters the development device, which renders the incoming image visible using toner. The toner image thus obtained is forwarded to the primary transfer nip at which the incoming image is transferred to the intermediate transfer belt 111 with an electrical bias applied to the primary transfer roller 125.

As the multiple imaging stations 112 sequentially produce toner images of different colors at the four transfer nips along the belt travel path, the primary toner images are superimposed one atop another to form a single multicolor image on the moving surface of the intermediate transfer belt 111 for subsequent entry to the secondary transfer nip between the secondary transfer roller 121 and the belt support roller.

Meanwhile, the sheet supply unit 114 picks up the recording sheet S from atop the sheet stack in the sheet tray 115 to introduce it between the pair of registration rollers 119 being rotated. Upon receiving the incoming sheet S, the registration rollers 119 stop rotation to hold the sheet S therebetween, and then advance it in sync with the movement of the intermediate transfer belt 111 to the secondary transfer nip at which the multicolor image is transferred from the belt 111 to the recording sheet S with an electrical bias applied to the secondary transfer roller.

After secondary transfer, the recording sheet S is introduced into the fixing device 20 to fix the toner image in place under heat and pressure. The recording sheet S, thus having its first side printed, is forwarded to a sheet diverter, which directs the incoming sheet S to an output roller pair 123 for output to the in-body output tray 118 along the primary path P when simplex printing is intended, or alternatively, to the media reversal unit 300 along the secondary path P2 when duplex printing is intended.

For duplex printing, the reversal unit 300 turns over the incoming sheet S for reentry to the sheet conveyance path P along the secondary path P1, so that the reversed sheet S again undergoes electrophotographic imaging processes including registration through the registration roller pair 119, secondary transfer through the secondary transfer nip, and fixing through the fixing device 100 to form another print on its second side opposite the first side.

Upon completion of simplex or duplex printing, the recording sheet S is output to the in-body output tray 118 for stacking inside the apparatus body, which completes one operational cycle of the image forming apparatus 100.

Figure 2:
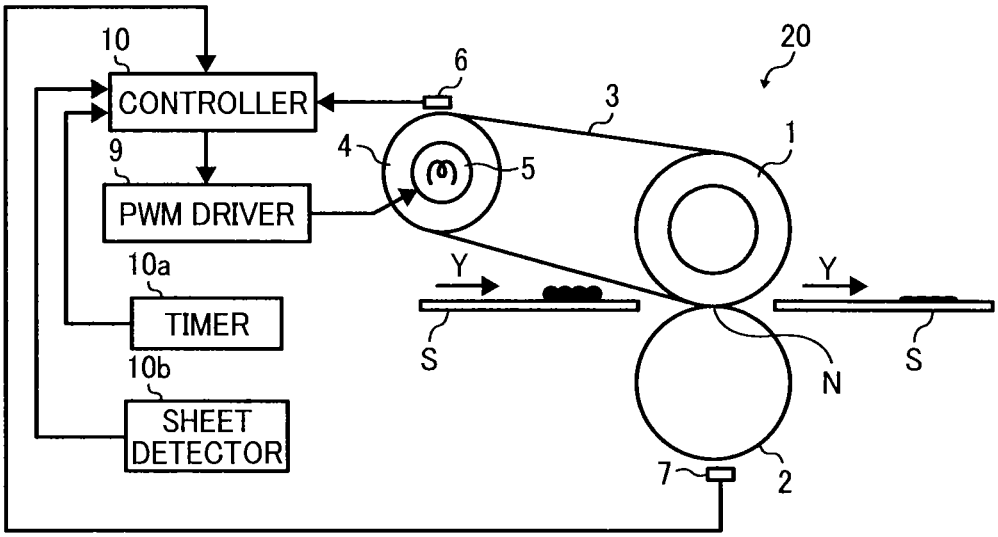
FIG. 2 is an end-on, axial cutaway view of the fixing device according to one embodiment of this patent specification.

FIG. 2 is an end-on, axial cutaway view of the fixing device 20 according to one embodiment of this patent specification.

As shown in FIG. 2, the fixing device 20 includes a fuser roller 1; a hollow, cylindrical heat roller 4 disposed parallel to the fuser roller 1; a heater 5 accommodated in the hollow inside of the heat roller 4; an endless, fuser belt 3 looped for rotation around the fuser roller 1 and the heat roller 4; and a pressure roller 2 disposed opposite the fuser roller 1 with the fuser belt 3 interposed between the pressure roller 2 and the fuser roller 1 to form a fixing nip N therebetween.

At least one of the opposing rollers 1 and 2 forming the fixing nip N is stationary or fixed in position with its rotational axis secured in position to a frame or enclosure of the apparatus body, whereas the other can be positioned with its rotational axis movable while biased elastically (for example, with a spring) against the opposite roller, so that moving the positionable roller relative to the stationary roller allows adjustment of a width of contact between the fuser and pressure members across the fixing nip N.

During operation, the fuser roller 1 rotates in a given rotational direction (i.e., counterclockwise in the drawing) to rotate the fuser belt 3 in the same rotational direction, which in turn rotates the pressure roller 2 in the opposite rotational direction (i.e., clockwise in the drawing). The heat roller 4 is internally heated by the heater 5 to heat a length of the rotating belt 3 to a heating temperature, which is controlled to sufficiently heat and melt toner particles through the fixing nip N.

As the rotary fixing members rotate together, a recording sheet S bearing an unfixed, powder toner image passes through the fixing nip N in a sheet conveyance direction Y to fix the toner image in place, wherein heat from the fuser belt 3 causes toner particles to fuse and melt, while pressure from the pressure roller 2 causes the molten toner to settle onto the sheet surface.

With continued reference to FIG. 2, the fixing device 20 is shown further including a heating controller 10 operatively connected to the heater 5 to control power supply to the heater 5 by adjusting a duty cycle or ratio between an on-time during which the heater power supply is on and an off-time during which the heater power supply is off. Also included are a power supply circuit incorporating a pulse-width modulation (PWM) driver 9 connected between the controller 10 and the heater 5; a first thermometer 6 being a non-contact sensor disposed adjacent to, and out of contact with, the fuser belt 3 to detect an operational temperature of the fuser belt 3 for communication to the controller 10; and a second thermometer 7 disposed adjacent to the pressure roller 2 to detect an operational temperature of the pressure roller 2 for communication to the controller 10.

During operation, the controller 10 adjusts the duty cycle of the heater 5 according to a differential between a specified setpoint temperature and an operational temperature detected in the fixing device 20. The controller 10 directs the PWM circuit 9 to switch on and off the heater power supply according to the duty cycle, so that the fuser belt 3 heated by the internally heated roller 4 imparts a sufficient amount of heat to the incoming sheet S for fixing the toner image through the fixing nip N.

Specifically, in the present embodiment, the heating controller 10 includes a central processing unit (CPU) that controls overall operation of the apparatus, as well as its associated memory devices, such as a read-only memory (ROM) storing program codes for execution by the CPU and other types of fixed data, a random-access memory (RAM) for temporarily storing data, and a rewritable, non-volatile random-access memory (NVRAM) for storing data during power-off.

The heater 5 may be any suitable heat source that can be controlled through on-off switching of electrical power supplied thereto. Examples include electrical resistance heater, such as a halogen lamp or a ceramic heater, as well as electromagnetic induction heater (IH). The heater 5 may be disposed at any position adjoining the fuser member 3. For example, the heater 5 may be positioned inside the heat roller 4 around which the fuser belt 3 rotates. Alternatively, instead, the heater 5 may be positioned in direct contact with the fuser belt 3.

In the present embodiment, the heater 5 is configured as a halogen heater disposed inside the heat roller 4. Operation of the halogen heater 5 may be controlled using a relay circuit that switches on and off an alternating current (AC) power supply to the heater 5 in accordance with the duty cycle. The halogen heater allows for an uncomplicated, inexpensive configuration of the heating equipment, while enabling a high-power output to reduce start-up time and recovery time required by the fixing process.

Figures 3, 4A, 4B, 4C:
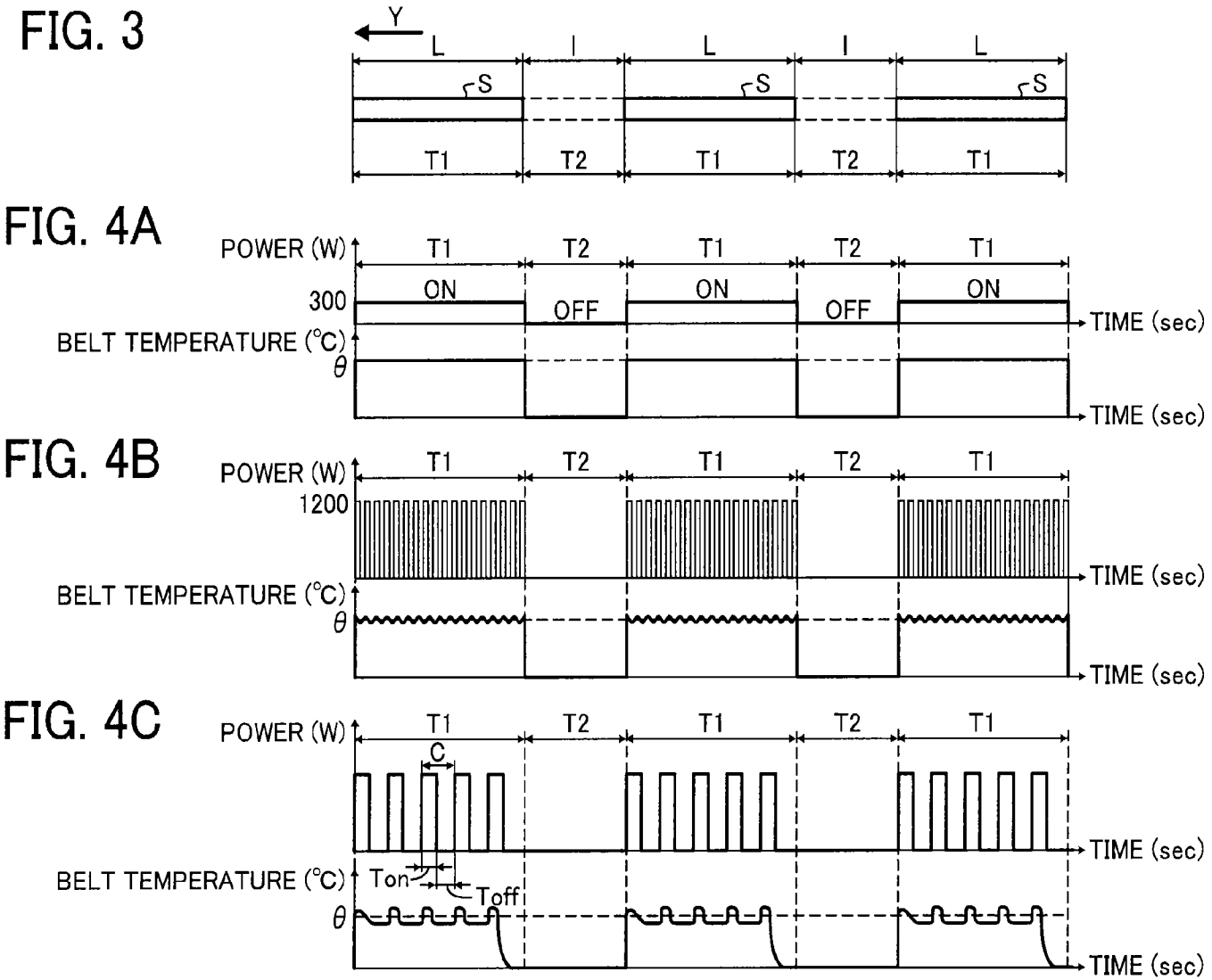
FIG. 3 is a schematic diagram illustrating sequential conveyance of multiple recording sheets through a fixing nip.
FIGS. 4A through 4C each presents exemplary graphs of heater power supply, in watts (W), and temperature, in degrees Celsius (° C.), of a fuser belt, plotted against time, in seconds (sec), during operation of the fixing device.

FIG. 3 is a schematic diagram illustrating sequential conveyance of multiple recording sheets S through the fixing nip N.

As shown in FIG. 3, the recording sheets S, each having a specific length L and spaced apart from each other by an interval distance l in the conveyance direction Y, are sequentially conveyed at a conveyance speed V through the fixing nip N. The sheet length L, the interval distance l, and the conveyance speed V together determine a length of sheet passage time T1 during which each recording sheet S passes through the fixing nip N, as well as a length of interval time T2 between two successive recording sheets S exiting and subsequently entering the fixing nip N.

For example, with the recording sheets S having a sheet length L of 210 mm and an interval distance l of 126 mm in the conveyance direction Y, sequentially conveying the sheets S at a conveyance speed V of 105 mm/sec results in a sheet passage time T1 of 2.0 seconds and an interval time T2 of 1.2 seconds, that is, a total time length T1+T2 of 3.2 seconds between two successive recording sheets entries through the fixing nip N.

FIGS. 4A through 4C each presents exemplary graphs of heater power supply, in watts (W), and temperature, in degrees Celsius (° C.), of the fuser belt, plotted against time, in seconds (sec), during operation of the fixing device.

As shown in FIG. 4A, for energy-efficient, high-quality fixing performance, the belt temperature is required to be constantly high at a designed heating temperature θ during the sheet passage time T1 and constantly low during the interval time T2. For example, where a halogen heater with a rated power of 1,200 W is employed, the heater needs to be activated with a power supply of 300 W during the sheet passage time T1, and deactivated during the interval time T2 to allow the required changes in the belt temperature.

As shown in FIG. 4B, the halogen heater may be powered through suitable switching circuitry, which controls the 1,200-W AC power supply through a control cycle that has a ratio of the on-time relative to the off-time being ⅓ for the output power of 300 W. In this case, the belt temperature is regulated without substantial deviation from the designed temperature θ during the sheet passage time T1 where the heater power supply is turned on and off at an extremely high switching frequency.

Although effective, however, such high-frequency switching control is difficult to implement where fast repetitive switching of the heater entails adverse consequences. For example, discontinuous power supply would result in insufficient heating of the halogen lamp, which hinders cyclic redeposition of evaporated tungsten to the filament, leading to accelerated degradation and concomitant damage to the filament. Moreover, variations in the heater power supply can interfere with other electronics connected to the mains power, causing, for example, flickering and dimming of lighting fixture where the image forming apparatus is installed.

As shown in FIG. 4C, in practice, in place of high-frequency switching control, the heater power supply is controlled through a series of on-off switching control cycles C, each including an on-time Ton during which the heater power supply is on, and an off-time Toff during which the heater power supply is off. For example, the series of control cycles C each may have a time duration of 0.4 seconds, including an on-time Ton of 0.1 seconds and an off-time Toff of 0.3 seconds. The 0.4-second control cycles C are repeated five times during the sheet passage time T1 and three times during the interval time T2 for the output power of 300 W.

Figure 5:
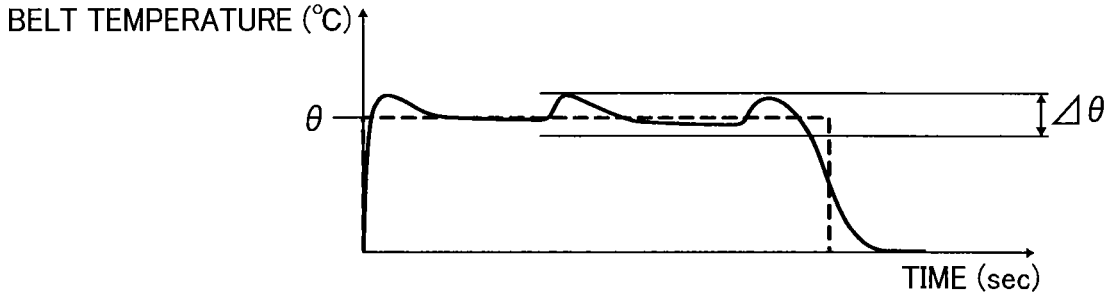
FIG. 5 is a graph illustrating an allowable range of deviation in the belt temperature.

With the heater power supply being thus turned on and off at a relatively low switching frequency, the belt temperature exhibits a certain amount of overshoot from the temperature θ during the on-time Ton, and a certain amount of undershoot from the temperature θ during the off-time Toff. Such low-frequency switching control can be effectively adapted for practical application to obtain adequate imaging quality where the temperature overshoot and undershoot remain below an allowable range Δθ of, for example, 3° C., that is, ±1.5° C. from the designed temperature θ, as shown in FIG. 5.

The inventors have recognized that one problem associated with a modern energy-efficient fixing process is the difficulty in keeping the temperature deviation within the allowable range during sequential processing of multiple recording media through the fixing nip.

Where the heater power supply is controlled independently of conveyance of the recording medium, a delay or difference in time may arise between when the recording medium enters the fixing nip and when the heater is activated to heat the fuser member. Such a lack of synchronization between heater activation and entry of the recording medium into the fixing nip results in variations in the amount of heat applied to the recording medium, leading to variations in fixing performance.

The problem is particularly pronounced where the equipment exhibits an extremely low heat capacity and thus an extremely fast thermal response to the heater switching on and off, as is the case with a small-diameter roller or a thin, flexible endless rotary belt. Although effective for reducing energy consumption, using such a fixing member makes it difficult to stabilize the temperature in the fixing process.

Figure 6:
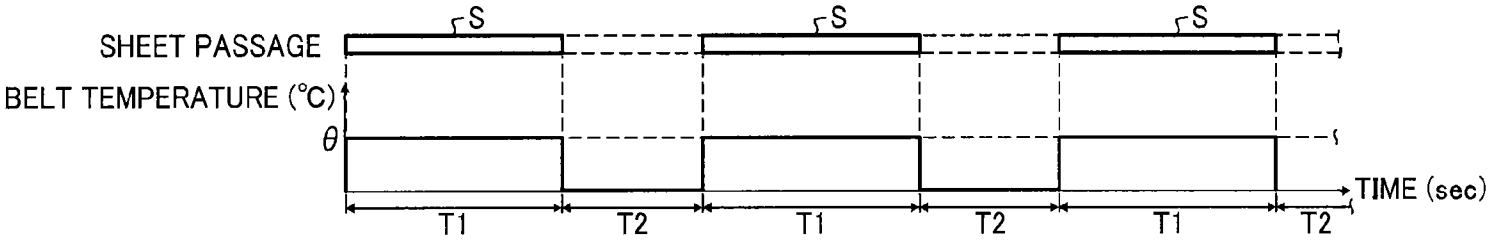
FIG. 6 is an exemplary graph of the belt temperature, in degrees Celsius (° C.), varying with time, in seconds (sec), as multiple recording sheets sequentially passes through the fixing nip.

FIG. 6 is an exemplary graph of the belt temperature, in degrees Celsius (° C.), varying with time, in seconds (sec), as multiple recording sheets S sequentially passes through the fixing nip N.

As shown in FIG. 6, for optimal, energy-efficient, high-quality fixing performance, the belt temperature is required to rise to a designed heating temperature θ as the leading edge of each recording sheet S reaches the fixing nip N, and subsequently fall from the heating temperature θ as the trailing edge of each recording sheet S exits the fixing nip N.

Figure 7:
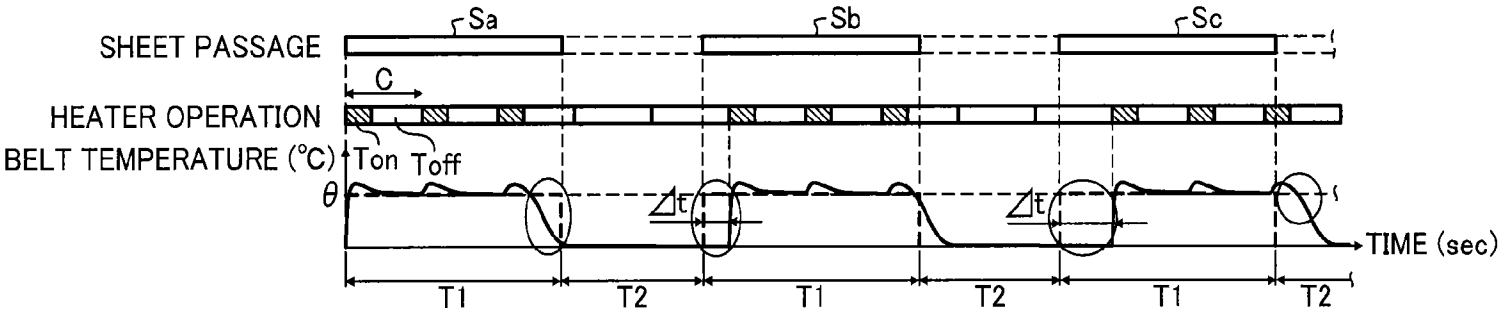
FIG. 7 is an exemplary graph of the belt temperature, in degrees Celsius (° C.), varying with time, in seconds (sec), obtained with a typical heating controller.

FIG. 7 is an exemplary graph of the belt temperature, in degrees Celsius (° C.), varying with time, in seconds (sec), where multiple recording sheets Sa, Sb, and Sc, each having an identical length and spaced apart from each other by a constant interval distance in a conveyance direction, are sequentially conveyed at a constant conveyance speed through the fixing nip N.

As shown in FIG. 7, in this example, the series of control cycles each has a constant duration C consisting of certain periods of an on-time Ton and an off-time Toff, the ratio of which is (although not explicitly presented herein) adjustable according to detected temperatures, such that the heater power supply is turned on approximately three times during passage of each recording sheet S through the fixing nip N.

Under typical heating control, the heater power supply is controlled independently of conveyance of the recording sheet S through the fixing nip N. As a result, changes in the belt temperature do not exactly conform to those required for optimal fixing performance. In particular, the beginning of the sheet passage time T1 does not always coincide with the beginning of the switching control cycle C, as indicated by a delay time Δt between when the recording sheet S enters the fixing nip N and when the heater is activated to heat the fuser belt.

Specifically, the belt temperature falling earlier than the exit of the first recording sheet Sa results in insufficient heating of the trailing edge of the sheet Sa. Further, the belt temperature rising later than the entry of the second recording sheet Sb results in insufficient heating of the leading edge of the sheet Sb. Moreover, the belt temperature rising significantly later than the entry of the third recording sheet Sc results in insufficient heating of the leading edge of the sheet Sc, followed by excessive heating of the trailing edge of the sheet Sc.

Thus, independent control of the heater power supply and conveyance of the recording medium S can preclude synchronization between heater activation and entry of the recording sheet S into the fixing nip N, which eventually results in variations in the amount of heat applied to the recording sheet S, leading to variations in fixing performance.

To address this and other problems, the fixing device 20 according to this patent specification incorporates a special heating control that controls power supply to the heater 5 through a series of on-off switching control cycles in synchronization with conveyance of the recording sheet S, such that a time interval between two successive recording sheets S entering the fixing nip N equals an integer multiple of a duration of one control cycle. The heating control can correct a duty ratio by adding an adjustable, gradually decreasing positive correction factor to the duty ratio.

Specifically, the heating controller 10 controls power supply to the heater 5 through a series of on-off switching control cycles, each including an on-time during which the heater power supply is on, and an off-time during which the heater power supply is off, in synchronization with conveyance of the recording sheet S to satisfy the following equation:

$$T1+T2=C*X \quad \text{Equation (1)}$$

where "T1" is a length of sheet passage time during which each recording sheet S passes through the fixing nip N, "T2" is a length of interval time between two successive recording sheets S exiting and subsequently entering the fixing nip N, "C" is a duration of the control cycle of the heater power supply, and "X" is a cycle count being a positive integer.

Given that the speed at which the fuser and pressure member rotate is constant during processing of a single recording sheet S, the above equation may be rewritten as follows:

$$(L+1)N=C*X \quad \text{Equation (1.1)}$$

where "L" is a length of the recording sheet S in the conveyance direction Y, "l" is a length of interval distance between two recording sheets S in the conveyance direction Y, and "V" is the conveyance speed at which the recording sheet S is conveyed.

Figure 8:
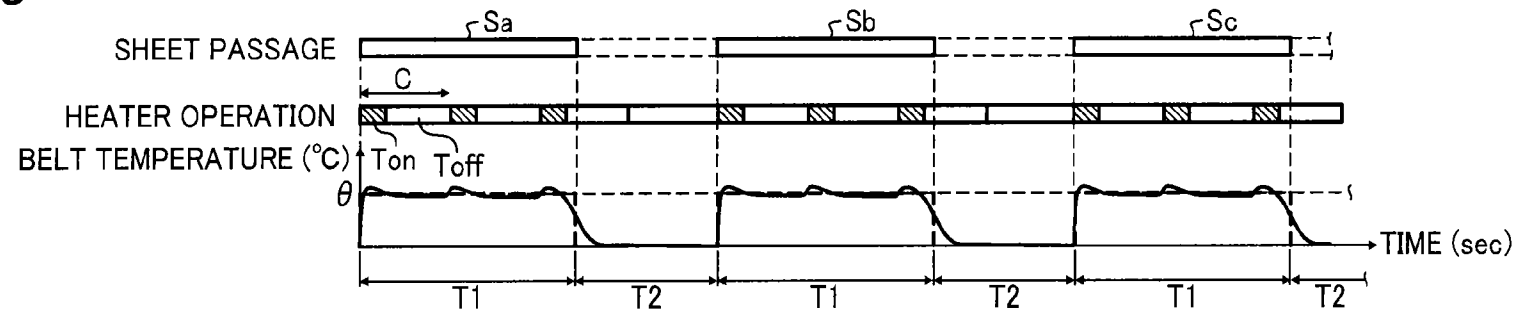
FIG. 8 is an exemplary graph of the belt temperature, in degrees Celsius (° C.), varying with time, in seconds (sec), obtained with a heating control included in the fixing device of FIG. 2.

FIG. 8 is an exemplary graph of the belt temperature, in degrees Celsius (° C.), varying with time, in seconds (sec), where multiple recording sheets Sa, Sb, and Sc, each having an identical length and spaced apart from each other by a constant interval distance in a conveyance direction, are sequentially conveyed at a constant conveyance speed through the fixing nip N, obtained with the heating controller 10.

As shown in FIG. 8, in this example, the series of control cycles each has a constant duration C consisting of certain periods of an on-time Ton and an off-time Toff, the ratio of which is (although not explicitly presented herein) adjustable according to detected temperatures, such that the heater power supply is turned on approximately three times during passage of each recording sheet S through the fixing nip N.

Under the heating control according to this patent specification, the heater power supply is controlled in synchronization with conveyance of the recording sheet S, such that the total time length T1+T2 between two successive recording sheets S entering the fixing nip N equals the duration of one control cycle C multiplied by the cycle count X of four. As a result, changes in the belt temperature substantially conform to those required for optimal fixing performance, as indicated by broken lines in the graph. In particular, the beginning of the sheet passage time T1 always coincides with the beginning of each switching control cycle, without a delay time between when the recording sheet S enters the fixing nip N and when the heater 5 is activated to heat the fuser belt 3.

By contrast, with additional reference to FIG. 7, where heater power supply is controlled independently of conveyance of the recording sheet S, an inequality between the product of the control cycle and the cycle count and the sum of the sheet passage time T1 and the interval time T2 causes a delay time Δt between when the recording sheet S enters the fixing nip N and when the heater is activated to heat the fuser belt.

Note that the delay time Δt increases as the number of recording sheets S processed increases to accumulate inequalities in timing between heater power supply and conveyance of the recording sheet S, resulting in variations in the number of times the heater power supply is turned on during passage of each recording sheet S through the fixing nip N.

Specifically, the heater power supply is turned on only two and a half times during passage of the third sheet Sc through the fixing nip N, which is 0.5 times smaller than that observed during passage of the first and second sheets Sa and Sb through the fixing nip N.

Thus, at an early stage during passage of the third sheet Sc through the fixing nip N, the heater remains deactivated so that the fuser belt remains relatively cold, resulting in insufficient heat supplied to the leading edge of the recording sheet Sc and concomitant variations in fixing performance. After passage of the third sheet Sc through the fixing nip N, the heater is activated to heat that portion of the fuser belt from which heat is no longer dissipated through contact with the recording sheet Sc, resulting in excessive heating of the fuser belt.

Moreover, a lack of synchronization between heater power supply and conveyance of the recording sheet S may result in insufficient heat supply to the fuser belt during processing of the first and second sheets Sa and Sb. Thus, depending on the extent to which the temperature of the fuser belt falls below a designed operational temperature, variations in fixing performance can occur during processing of the first and second sheets Sa and Sb.

No such problems take place in the fixing device 20 incorporating the heating controller 10 according to this patent specification, which maintains the product of the control cycle and the cycle count equal to the sum of the sheet passage time T1 and the interval time T2.

Specifically, the heating control causes each recording sheet S to enter the fixing nip N simultaneously with the heater 5 being activated. The result is an identical number of times the heater power supply is turned on during passage of each recording sheet S through the fixing nip N, which prevents insufficient heat supplied to the leading edge of the recording sheet S and concomitant variations in fixing performance.

Moreover, the heating control causes the heater 5 to remain deactivated during the interval time T2 between two successive recording sheets S exiting and subsequently entering the fixing nip N. Timely activation and deactivation of the heater 5 prevents excessive heating of the fuser belt 3, which would occur where the fuser belt 3 is subjected to heating as it loses thermal contact with the recording sheet S during the interval time T2.

Thus, the heating control according to this patent specification can effectively synchronize heater activation and entry of the recording medium S into the fixing nip N, leading to optimal, energy-efficient, and high-quality fixing performance of the fixing device 20.

The controller 10 may adjust at least one of the conveyance speed V, the interval distance l, the cycle duration C, the cycle count X, and combinations thereof to keep the Equation (1) satisfied. Adjustment to those parameters may be performed depending on a print job or application in which printing is performed with a specific imaging speed or rating of pages per minute (PPM), that is, the number of recording sheets S passing through the fixing nip N during one minute, using a particular type of recording medium S having a specific length L in the conveyance direction Y, such as a long edge of A4 size, a short edge of A4 size, a long edge of A3 size, a short edge of A3 size, a long edge of letter size, and a short edge of letter size.

For example, the cycle duration C and the cycle count X may be selectively adjusted where the conveyance speed V and the interval distance l are determined by a given imaging speed. Further, not only the cycle duration C and the cycle count X, but also the conveyance speed V and the interval distance l may be adjusted where the imaging speed is changeable. Several such embodiments are described below.

In one embodiment, the controller 10 adjusts a combination of the cycle duration C and the cycle count X to accommodate changes in the conveyance speed V causing corresponding changes in the total time length T1+T2, which may occur, for example, depending on a specific rating of PPM.

Specifically, the controller 10 selects a suitable combination of the cycle duration C and the cycle count X using a lookup table stored in a memory device accessible by the controller 10, which associates different values of the conveyance speed V with different combinations of the parameters C and X. Such a lookup table may contain a combination of parameters C and X for all possible values of the variable, or otherwise for at least values associated with frequently used print settings, such as A4-, A3-, and letter-sized paper sheets. Table 1 below provides an exemplary lookup table for heating control according to the present embodiment.

TABLE 1

| | | | | | X |
|---|---|---|---|---|---|
| PPM | 20 | 30 | 40 | 50 | |
| L (mm) | 210 | 210 | 210 | 210 | |
| l (mm) | 60 | 60 | 60 | 60 | |
| V (mm/sec) | 90 | 135 | 180 | 225 | |
| T1 + T2 (sec) | 3 | 2 | 1.5 | 1.2 | |
| C (msec) | 3,000 | 2,000 | 1,500 | 1,200 | 1 |
| | 1,500 | 1,000 | 750 | 600 | 2 |
| | 1,000 | 667 | 500 | 400 | 3 |
| | 750 | 500 | 375 | 300 | 4 |
| | 600 | 400 | 300 | 240 | 5 |
| | 500 | 333 | 250 | 200 | 6 |
| | 429 | 286 | 214 | 171 | 7 |
| | 375 | 250 | 188 | 150 | 8 |
| | 333 | 222 | 167 | 133 | 9 |
| | 300 | 200 | 150 | 120 | 10 |

In Table 1, values are presented for application in four types of imaging equipment, each operated with a particular conveyance speed V for A4-size, long-edge feed paper. Values of the cycle duration C are rounded off to the nearest integer.

Reducing the cycle duration C may increase controllability of the fuser temperature, while too short a cycle duration would result in accelerated degradation of the halogen heater or flickering of lighting equipment. To obtain good controllability without adverse effects, the cycle duration C may be set to a sufficiently long range of, for example, 600 milliseconds or longer.

For example, the following combinations may be selected based on Table 1: a cycle duration C of 600 msec and a cycle count X of 5 for a speed V of 90 mm/sec; a cycle duration C of 667 msec and a cycle count X of 3 for a speed V of 135 mm/sec; a cycle duration C of 750 msec and a cycle count X of 2 for a speed V of 180 mm/sec; and a cycle duration C of 600 msec and a cycle count X of 2 for a speed V of 225 mm/sec.

In further embodiment, the controller 10 adjusts a combination of the cycle duration C and the cycle count X to accommodate changes in the length L of the recording medium in the conveyance direction Y causing corresponding changes in the total time length T1+T2, which may occur, for example, depending on a specific print job.

Specifically, as is the case with the foregoing embodiment, the controller 10 selects a suitable combination of the cycle duration C and the cycle count X using a lookup table stored in a memory device accessible by the controller 10, which associates different values of the sheet length L with different combinations of the parameters C and X. Such a lookup table may contain a combination of combinations of parameters C and X for all possible values of the variable, or otherwise for at least values associated with frequently used print settings, such as A4-, A3-, and letter-sized paper sheets.

In still further embodiment, the controller 10 adjusts a combination of the interval distance l and the cycle count X to accommodate changes in the conveyance speed V causing corresponding changes in the total time length T1+T2.

Specifically, as is the case with the foregoing embodiment, the controller 10 selects a suitable combination of the interval distance l and the cycle count X using a lookup table stored in a memory device accessible by the controller 10, which associates different values of the conveyance speed V with different combinations of the parameters 1 and X. Table 2 below provides an exemplary lookup table for heating control according to the present embodiment.

TABLE 2

| | | | | | X | T1 + T2 (sec) | PPM |
|---|---|---|---|---|---|---|---|
| L (mm) | 210 | 210 | 210 | 210 | | | |
| C (msec) | 600 | 600 | 600 | 600 | | | |
| V (mm/sec) | 90 | 135 | 180 | 225 | | | |
| l (mm) | −156* | −129* | −102* | −75* | 1 | 0.6 | 100.0 |
| | −102* | −48* | 6 | 60 | 2 | 1.2 | 50.0 |
| | −48* | 33 | 114 | 195 | 3 | 1.8 | 33.3 |
| | 6 | 114 | 222 | 330 | 4 | 2.4 | 25.0 |
| | 60 | 195 | 330 | 465 | 5 | 3.0 | 20.0 |
| | 114 | 276 | 438 | 600 | 6 | 3.6 | 16.7 |
| | 168 | 357 | 546 | 735 | 7 | 4.2 | 14.3 |
| | 222 | 438 | 654 | 870 | 8 | 4.8 | 12.5 |
| | 276 | 519 | 762 | 1,005 | 9 | 5.4 | 11.1 |
| | 330 | 600 | 870 | 1,140 | 10 | 6.0 | 10.0 |

In Table 2, values are presented for application in four types of imaging equipment, each operated with a particular conveyance speed V for A4-size, long-edge feed paper. Values marked with asterisks (*) indicate negative, invalid values for the interval distance l, which are presented only for illustration.

For example, the following combinations may be selected based on Table 2: an interval distance l of 60 mm and a cycle count X of 5 for a speed V of 90 mm/sec, yielding a total time length T1+T2 of 3.0 sec and PPM of 20.0; an interval distance l of 114 mm and a cycle count X of 4 for a speed V of 135 mm/sec, yielding a total time length T1+T2 of 2.4 sec and PPM of 25.0; an interval distance l of 114 mm and a cycle count X of 3 for a speed V of 180 mm/sec, yielding a total time length T1+T2 of 1.8 sec and PPM of 33.3; and an interval distance l of 60 mm and a cycle count X of 2 for a speed V of 225 mm/sec, yielding a total time length T1+T2 of 1.2 sec and PPM of 50.0.

Since changing the interval distance l causes a corresponding change in the PPM value, the configuration described above is applicable where variations in the imaging speed are allowable. Alternatively, instead, where the imaging speed is unchangeable, the controller 10 may adjust the interval distance l and the cycle count X for each of the multiple recording sheets S to maintain a constant imaging speed during execution of a print job.

Figure 9:
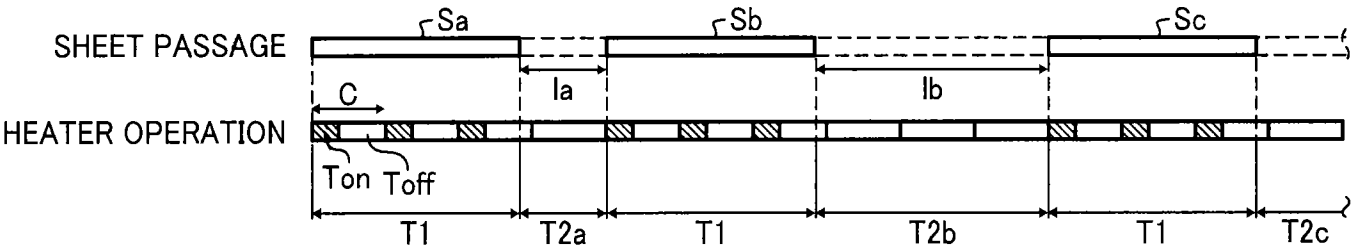
FIG. 9 is a schematic diagram illustrating an arrangement of the heating control of FIG. 8.

With reference to FIG. 9, during sequential processing of multiple recording sheets S, the controller 10 specifies different combinations of the interval distance l and the cycle count X for three successive recording sheets Sa, Sb, and Sc. For example, the first recording sheet Sa is processed with a relatively short interval distance la and a smaller cycle count X of 4, whereas the second sheet Sb is processed with a relatively long interval distance lb and a greater cycle count X of 6. Such arrangement enables synchronization between heater activation and entry of the recording medium into the fixing nip without causing variations in the imaging speed.

Figure 10:
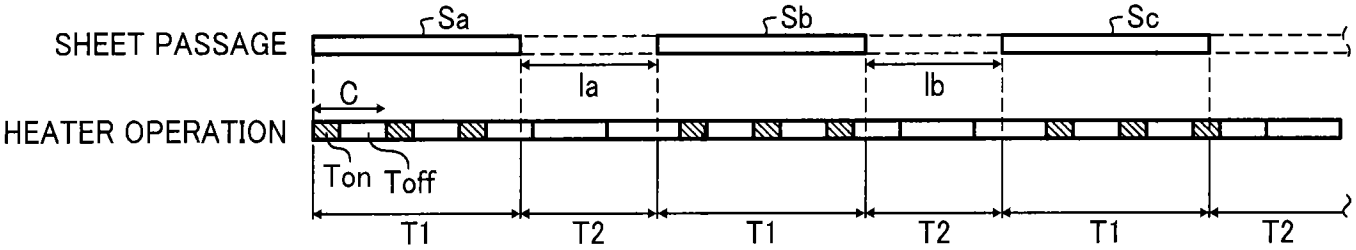
FIG. 10 is a schematic diagram illustrating a typical heating control.

For comparison purposes, consider a case where heating control is performed without adjustment to the interval distance l and the cycle count X, with reference to FIG. 10.

As shown in FIG. 10, although causing no variations in the imaging speed, operation with the fixed interval distance l and the fixed cycle count X would result in a delay time between when each of the second and third recording sheets Sb and Sc enters the fixing nip N and when the heater is activated to heat the fuser belt, leading to variations in fixing performance.

As mentioned earlier, in the fixing device 20 according to this patent specification, the heating controller 10 can correct a duty ratio by adding an adjustable, gradually decreasing positive correction factor to the duty ratio. A description is now given of such features of the fixing device 20.

The inventors have recognized that in the fixing device using a pair of fuser and pressure member forming a fixing nip therebetween, the temperature of the fuser member can transiently fall below a designed operational temperature due to a sudden, sharp decrease in the temperature of the pressure member as the recording medium absorbs a certain amount of heat from the pressure member during passage through the fixing nip.

Any factor that changes the amount of heat transmitted from the pressure member to the recording medium may influence the temperature of the pressure member. Several such factors include properties of the recording medium and operational conditions with which printing is performed, such as media weight, media temperature, conveyance speed, and a ratio of the media passage time relative to a sum of the media passage time and the interval time in the control cycle. Significantly large variations in the temperature of the pressure member tend to occur upon initial passage of a recording medium through the fixing nip after startup, recovery, maintenance, or any extended period of non-operation during which the pressure member remains in thermal contact with the fuser member preliminarily heated to its designed operational temperature without substantial loss of heat from the fuser member in the absence of a recording medium passing through the fixing nip.

Figure 11A:
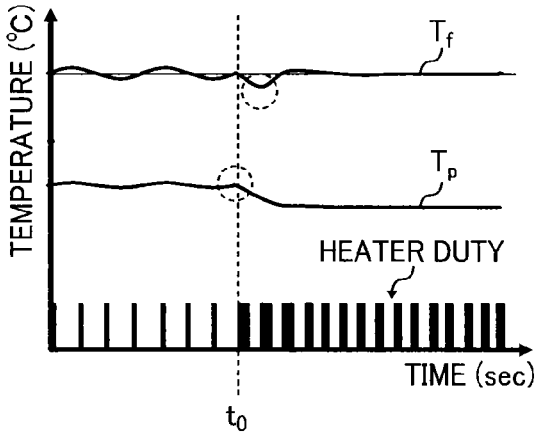
FIGS. 11A and 11B each presents graphs showing the temperature of a fuser member and the temperature of a pressure member, both in degrees Celsius (° C.), varying with time, in seconds, obtained in a typical fixing device.
Figure 11B:
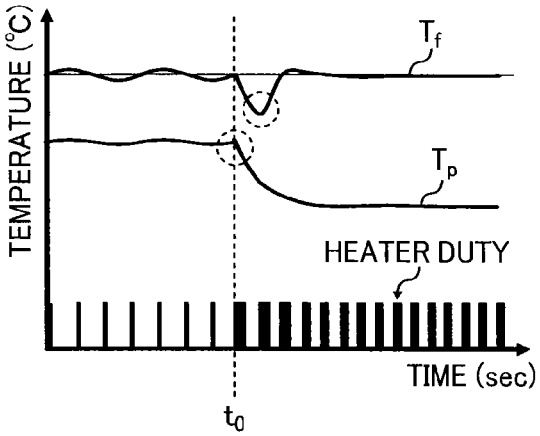

FIGS. 11A and 11B each presents graphs showing the temperature Tf of a fuser member and the temperature Tp of a pressure member, both in degrees Celsius (° C.), varying with time, in seconds, obtained in a typical fixing device.

As shown in FIG. 11A, where the temperature Tp originally remains relatively low, the temperature Tp does not significantly change from the original level upon initial passage of a recording medium through the fixing nip at time t0. As a result, the temperature Tf does not substantially change from the designed, original operational temperature.

By contrast, as shown in FIG. 11B, where the temperature Tp originally remains relatively high, the temperature Tp suddenly decrease from the original level upon initial passage of a recording medium through the fixing nip at time t0. As a result, the temperature Tf transiently and significantly fall below the designed, original operational temperature, leading to insufficient heating and concomitant variations in fixing performance.

To prevent a transient fall of the temperature Tf of the fuser member 3 due to a sudden, sharp decrease in the temperature Tp of the pressure member 2, the heating control according to this patent specification can change the duration of time in which the heater 5 is supplied with power depending on a factor or combination of factors that changes the amount of heat transmitted from the pressure member 3 to the recording medium S, so as to compensate for a change in the temperature Tp of the pressure member 2 upon initial passage of the recording medium S through the fixing nip N after an extended period of non-operation.

Specifically, the heating controller 10 corrects a duty ratio, being a ratio of the on-time relative to a sum of the on-time and the off-time, by adding a positive correction factor to the duty ratio, as given by the following equation:

$$D=Di+F \qquad \text{Equation (2)}$$

where "D" represents a corrected duty ratio, "Di" represents an original, uncorrected duty ratio, and "F" represents a positive correction factor.

The positive correction factor F to be added to the duty ratio Di decreases with an increasing number of control cycles performed, as given by the following equation:

$$Fm=Di*\{r-d*(m-1)\}\geq 0 \qquad \text{Equation (3)}$$

where "Fm" represents a correction factor for an m-th control cycle since initial passage of a recording sheet S through the fixing nip N, "Di" represents an original, uncorrected duty ratio, "r" represents an initial amplification rate, and "d" represents a decrement.

The controller 10 may perform correction to the duty ratio upon any occasion where the recording sheet S initially passes through the fixing nip N after an extended period of non-operation, such as, for example, after an interruption for adjustment to the system or at an early stage during execution of a print job, causing a sudden, sharp decrease in the temperature of the pressure member 2.

The decrement d as well as the number of control cycles in which the correction factor F is added to the duty ratio Di may be determined such that the correction factor F reaches zero concurrently with the temperature Tp of the pressure member 2 stops decreasing since initial passage of the recording sheet S through the fixing nip N. Thus, the controller 10 terminates correction to the duty ratio as the temperature Tp of the pressure member 2 is stabilized.

Where stabilization of the temperature Tp requires a certain period of time during which a certain number of recoding sheets S may pass through the fixing nip N, the number of recording sheets S processed with the corrected duty ratio is not limited to one, and may vary depending on the size of recording sheet S used and other operational conditions under which printing is performed.

The controller 10 may perform correction to the duty ratio in a condition in which the temperature Tp of the pressure member 2 equals or exceeds a given threshold temperature Tth of, for example, 120° C. The controller 10 may determine the temperature Tp of the pressure member 2 through measurement, estimation, or combination of both.

For example, the controller 10 may perform correction to the duty ratio where a temperature Tp of the pressure member 2 measured by the thermometer 7 before initial entry of the recording sheet S into the fixing nip N equals or exceeds the threshold temperature Tth. Alternatively, instead, measurement of the temperature Tp may be performed after initial entry of the recording sheet S into the fixing nip N, followed by subsequent correction to the duty ratio.

Further, the controller 10 may estimate a temperature Tp of the pressure member 2 based on the temperature Tf of the fuser member 3 measured before initial entry of the recording sheet S into the fixing nip N, and perform correction to the duty ratio where the estimated temperature Tp of the pressure member 2 equals or exceeds the threshold temperature Tth. In this case, the controller 10 may perform correction to the duty ratio except where the temperature Tf of the fuser member 3 equals or exceeds a setpoint temperature by equal to or more than a given temperature difference Td of, for example, 20° C.

Still further, the controller 10 may estimate a temperature Tp of the pressure member 2 based on the length of interval time T2 between two successive recording sheets S exiting and subsequently entering the fixing nip N, and perform correction to the duty ratio where the estimated temperature Tp of the pressure member 2 equals or exceeds the threshold temperature Tth. In this case, correction to the duty ratio may be enabled where the interval time T2 equals or exceeds a threshold of, for example, 5 seconds due to adjustment to the system, or for accommodating a change in productivity, causing an increase in the temperature Tp of the pressure member 2.

Furthermore, the controller 10 may estimate a temperature Tp of the pressure member 2 based on the conveyance speed V of the recording sheet S, and perform correction to the duty ratio where the estimated temperature Tp of the pressure member 2 equals or exceeds the threshold temperature Tth.

Enabling or disabling correction to the duty ratio depending on the temperature of the pressure member 2 and/or the fuser member 3 prevents adverse effects where the temperature Tp of the pressure member 2 is relatively low, or where the temperature Tf of the fuser member 3 is relatively high, in which cases temporary increase of the duty ratio would excessively and unnecessarily heat the fuser member 3, causing an overshoot in the temperature Tf of the fuser member.

Specific values of the threshold temperature Tth and the temperature difference Td are not limited to those exemplarily shown herein, but may be suitably modified depending on specific configurations of the fixing device 20, including the size of recording medium S and other operational conditions under which printing is performed.

Figure 12A:
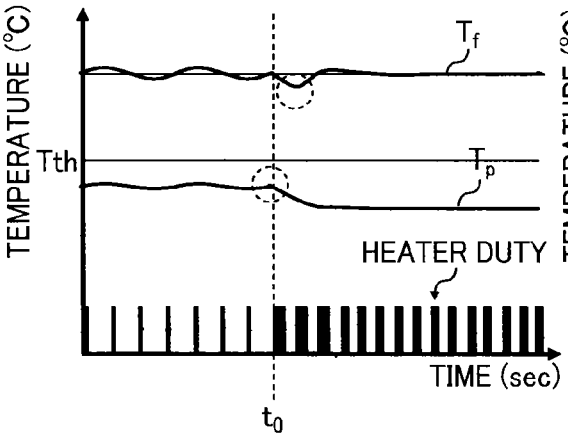
FIGS. 12A and 12B each presents graphs showing the temperature of a fuser member and the temperature of a pressure member, both in degrees Celsius (° C.), varying with time, in seconds, obtained where the heating control corrects a duty ratio with an adjustable correction factor according to one embodiment of this patent specification.
Figure 12B:
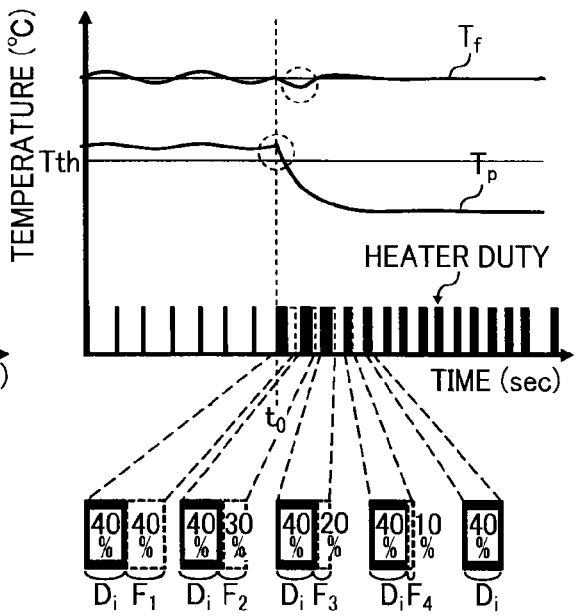

FIGS. 12A and 12B each presents graphs showing the temperature Tf of the fuser member 3 and the temperature Tp of the pressure member 2, both in degrees Celsius (° C.), varying with time, in seconds, obtained where the heating controller 10 corrects the duty ratio with an adjustable correction factor according to one embodiment of this patent specification.

As shown in FIG. 12A, where the temperature Tp originally remains relatively low, the temperature Tp does not significantly change from the original level upon initial passage of the recording sheet S through the fixing nip N at time t0. As a result, the temperature Tf does not substantially change from the designed, original operational temperature. In this case, the controller 10 does not perform correction to the duty ratio as the temperature Tp of the pressure member 2 does not exceed the threshold temperature Tth.

By contrast, as shown in FIG. 12B, where the temperature Tp originally remains relatively high, the temperature Tp suddenly decrease from the original level upon initial passage of the recording sheet S through the fixing nip at time t0. In this case, the controller 10 performs correction to the duty ratio since the temperature Tp of the pressure member 2, as measured before initial entry of the recording sheet S into the fixing nip N, is higher than the threshold temperature Tth.

Specifically, in the present embodiment, the fixing device 20 is configured with an original, uncorrected duty ratio Di of 40%, an initial amplification rate r of 1, and a decrement d of 0.25. In such cases, after time t0 where the recording sheet S initially enters the fixing nip N, the controller 10 corrects the duty ratio in the first control cycle by adding a correction factor F1 of 40% to the original duty ratio Di of 40%, yielding a corrected duty ratio D1 of 80%. For the second through fourth control cycles after time t0, the corrected duty ratios D2, D3, and D4 are 70%, 60%, and 50%, respectively, as obtained by adding correction factors F2, F3, and F4 of 30%, 20%, and 10%, respectively, to the original duty ratio Di of 40%. The duty ratio D5 for the fifth control cycle after time t0 is identical to the original duty ratio Di, since at this point the correction factor F reaches zero.

In further embodiments, the controller 10 can adjust the correction factor F to be added to the duty ratio Di depending on a variable parameter with which printing is performed. The variable parameter includes any factor or combination of factors that changes the amount of heat transmitted from the pressure member 2 to the recording medium S, including, for example, properties of the recording medium S and operational conditions with which printing is performed. Several such embodiments are described below.

In one embodiment, the controller 10 adjusts the correction factor F to be added to the duty ratio Di depending on a grammage or weight per unit area of the recording sheet S, so as to compensate for an expected change in the temperature of the pressure member 2 where the recording sheet S absorbs a certain amount of heat from the pressure member 2 as it passes through the fixing nip N.

Specifically, in the present embodiment, the controller 10 performs adjustment to the correction factor by referring to a reference, lookup table that associates specific ranges of the sheet weight with values of the initial amplification rate r and the decrement d from which the correction factor F is determined. An exemplary reference table for duty ratio adjustment is shown in Table 3 below.

TABLE 3

| sheet weight range (g/m$^2$) | conveyance speed (mm/sec) | sheet length (mm) | initial amplification rate | decrement |
|---|---|---|---|---|
| ~60 | 200 | 210 | 0.75 | 0.25 |
| 61~90 | 200 | 210 | 1 | 0.25 |
| 91~120 | 200 | 210 | 1.25 | 0.25 |

As indicated in Table 3, the initial amplification rate r is set to different values for three ranges of sheet weight, that is, 0.75 for a recording sheet weighing no more than 60 g/m$^2$, 1 for a recording sheet weighing in a range of 61 to 90 g/m$^2$, and 1.25 for a recording sheet weighing in a range of 91 to 120 g/m$^2$, respectively. The decrement d is set to 0.25 for all the three ranges of paper weight.

Figure 13A:
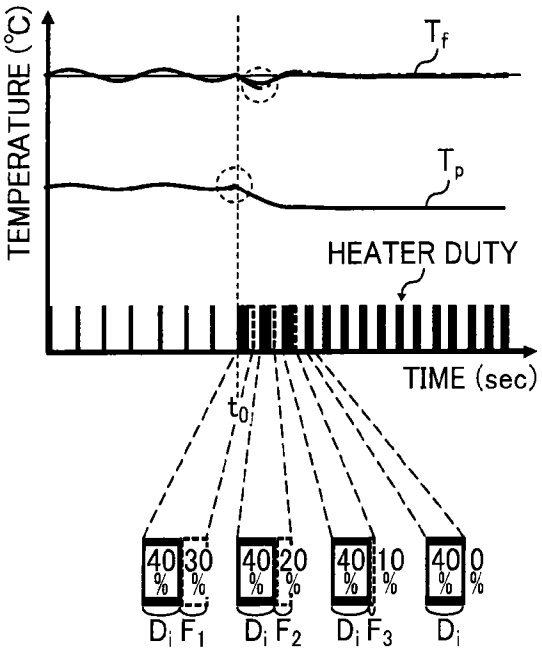
FIGS. 13A through 13C each presents graphs showing the temperature of the fuser member and the temperature of the pressure member, both in degrees Celsius (° C.), varying with time, in seconds, obtained where the correction factor is adjusted for different sheet weights.
Figure 13B:
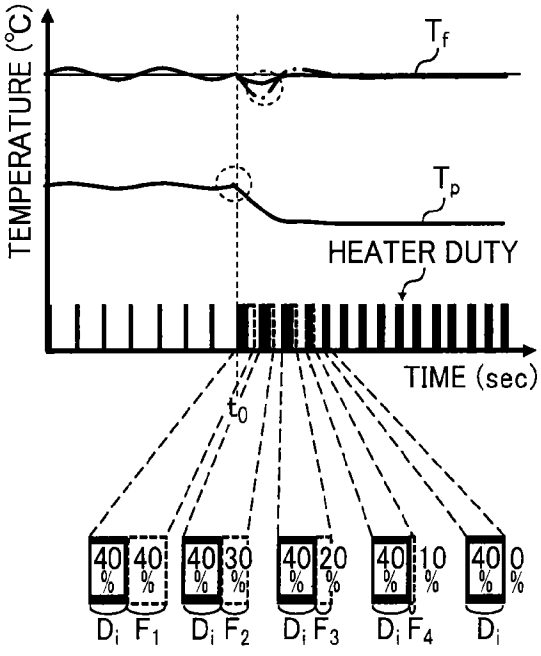
Figure 13C:
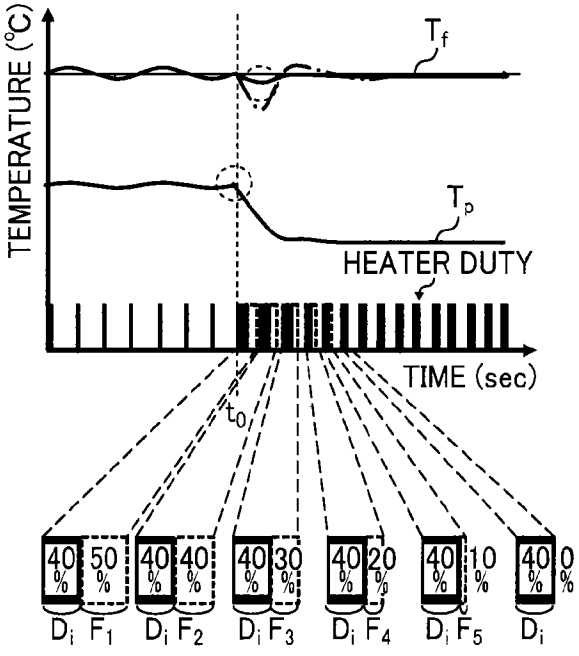

FIGS. 13A through 13C each presents graphs showing the temperature Tf of the fuser member 3 and the temperature Tp of the pressure member 2, both in degrees Celsius (° C.), varying with time, in seconds, obtained where the correction factor is adjusted for different sheet weights of 60 g/m$^2$, 90 g/m$^2$, and 120 g/m$^2$, respectively.

As shown in FIGS. 13A through 13C, the amount by which the temperature Tp of the pressure member 2 decreases upon initial passage of the recording sheet S through the fixing nip N at time t0 varies depending the weight of the recording sheet S, as the amount of heat absorbed by the recording sheet S from the pressure member 2 changes with the heat capacity of the recording sheet S which is proportional to the weight of recording sheet S. Without any adjustment to the duty ratio, the temperature Tf of the fuser member 3 would decrease along with the temperature Tp of the pressure member 2, as indicated by broken lines in the graphs.

In such cases, the controller 10 increases the correction factor F by increasing the initial amplification rate r with increasing ranges of the sheet weight, while keeping the decrement d constant.

In the present embodiment, for the recording sheet of 60 g/m$^2$, the initial amplification rate r is set to 0.75, and the decrement d is set to 0.25 (FIG. 13A). For the recording sheet of 90 g/m$^2$, the initial amplification rate r is set to 1, and the decrement d is set to 0.25 (FIG. 13B). For the recording sheet of 120 g/m$^2$, the initial amplification rate r is set to 1.25, and the decrement d is set to 0.25 (FIG. 13C).

In another embodiment, the controller 10 adjusts the correction factor F to be added to the duty ratio Di depending on a temperature of the recording sheet S, so as to compensate for an expected change in the temperature of the pressure member 2 where the recording sheet S absorbs a certain amount of heat from the pressure member 2 as it passes through the fixing nip N.

Specifically, in the present embodiment, the controller 10 increases the correction factor F by increasing the initial amplification rate r as the temperature of the recording sheet S decreases. The temperature of the recording sheet S may be obtained through measurement using a suitable thermometer directed to the recording sheet S upstream from the fixing nip N, or through estimation from an environmental temperature with which the fixing device 20 is operated.

In still another embodiment, the controller 10 adjusts the correction factor F to be added to the duty ratio Di depending on the conveyance speed V at which the recording sheet S is conveyed, so as to compensate for an expected change in the temperature of the pressure member 2 where the recording sheet S absorbs a certain amount of heat from the pressure member 2 as it passes through the fixing nip N.

Specifically, in the present embodiment, the controller 10 performs adjustment to the correction factor by referring to a reference, lookup table that associates specific values of the conveyance speed with values of the initial amplification rate r and the decrement d from which the correction factor F is determined. An exemplary reference table for duty ratio adjustment is shown in Table 4 below.

TABLE 4

| sheet weight range (g/m$^2$) | conveyance speed (mm/sec) | sheet length (mm) | initial amplification rate | decrement |
|---|---|---|---|---|
| 61~90 | 100 | 210 | 0.75 | 0.25 |
| 61~90 | 200 | 210 | 1 | 0.25 |
| 61~90 | 300 | 210 | 1.25 | 0.25 |

As indicated in Table 4, the initial amplification rate r is set to different values for three values of conveyance speed, that is, 0.75 for a conveyance speed of 100 mm/sec, 1 for a conveyance speed of 200 mm/sec, and 1.25 for a conveyance speed of 300 mm/sec, respectively. The decrement d is set to 0.25 for all the three values of the conveyance speed.

Figure 14A:
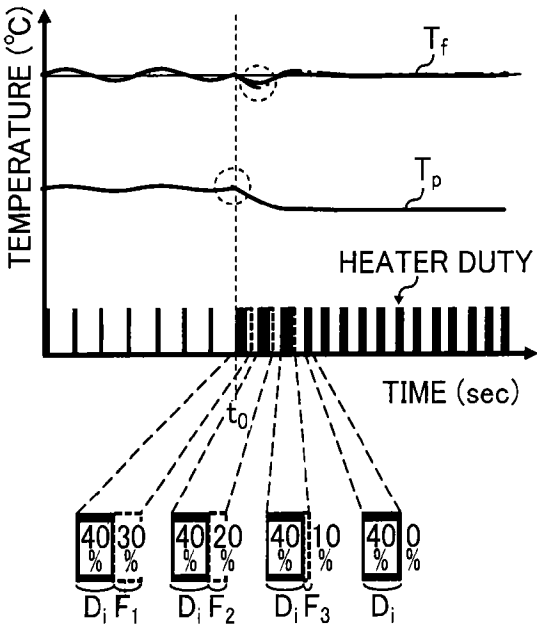
FIGS. 14A through 14C each presents graphs showing the temperature of the fuser member and the temperature of the pressure member, both in degrees Celsius (° C.), varying with time, in seconds, obtained where the correction factor is adjusted for different conveyance speeds.
Figure 14B:
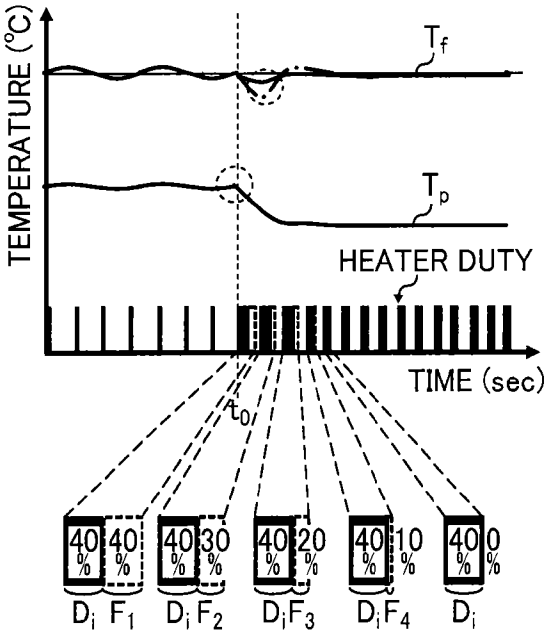
Figure 14C:
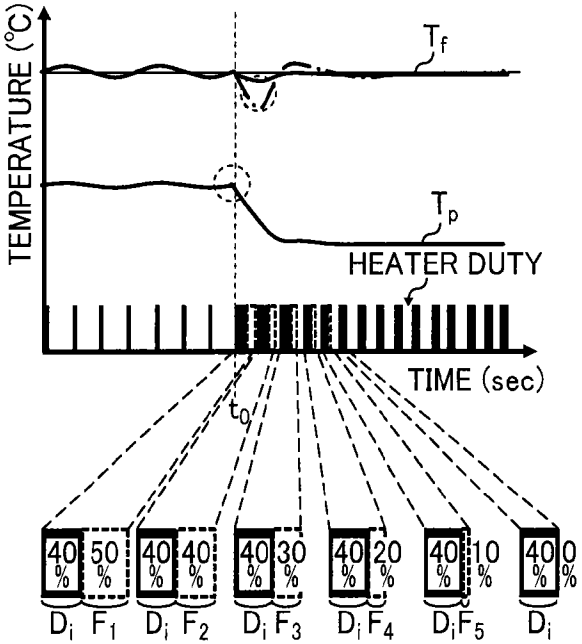

FIGS. 14A through 14C each presents graphs showing the temperature Tf of the fuser member 3 and the temperature Tp of the pressure member 2, both in degrees Celsius (° C.), varying with time, in seconds, obtained where the correction factor is adjusted for different conveyance speeds of 100 mm/sec, 200 mm/sec, and 300 mm/sec, respectively.

As shown in FIGS. 14A through 14C, the amount by which the temperature Tp of the pressure member 2 decreases upon initial passage of the recording sheet S through the fixing nip N at time t0 varies depending on the conveyance speed V, as the amount of heat absorbed by the recording sheet S from the pressure member 2 changes with the rate at which the recording sheet S passes through the fixing nip N. Without any adjustment to the duty ratio, the temperature Tf of the fuser member 3 would decrease along with the temperature Tp of the pressure member 2, as indicated by broken lines in the graphs.

In such cases, the controller 10 increases the correction factor F by increasing the initial amplification rate r with increased values of the conveyance speed V, while keeping the decrement d constant.

In the present embodiment, for the conveyance speed of 100 mm/sec, the initial amplification rate r is set to 0.75, and the decrement d is set to 0.25 (FIG. 14A). For the conveyance speed of 200 mm/sec, the initial amplification rate r is set to 1, and the decrement d is set to 0.25 (FIG. 14B). For the conveyance speed of 300 mm/sec, the initial amplification rate r is set to 1.25, and the decrement d is set to 0.25 (FIG. 14C).

In yet still another embodiment, the controller 10 adjusts the correction factor F to be added to the duty ratio Di depending on a ratio of the sheet passage time T1 relative to a sum of the sheet passage time T1 and the interval time T2, so as to compensate for an expected change in the temperature of the pressure member 2 where the recording sheet S absorbs a certain amount of heat from the pressure member 2 as it passes through the fixing nip N.

Specifically, in the present embodiment, the controller 10 adjusts a rate at which the correction factor F decreases depending on the time ratio T1/(T1+T2). The controller 10 performs adjustment to the correction factor by referring to a reference, lookup table which associates specific values of the time ratio T1/(T1+T2) with values of the initial amplification rate r and the decrement d from which the correction factor F is determined. An exemplary reference table for duty ratio adjustment is shown in Table 5 below.

TABLE 5

| sheet weight range (g/m$^2$) | conveyance speed (mm/sec) | sheet length (mm) | interval distance (mm) | T1/ (T1 + T2) | initial amplification rate | decrement |
|---|---|---|---|---|---|---|
| 61~90 | 200 | 149 | 70 | 0.68 | 1 | 0.4 |
| 61~90 | 200 | 210 | 70 | 0.75 | 1 | 0.25 |
| 61~90 | 200 | 297 | 70 | 0.81 | 1 | 0.1 |

As indicated in Table 5, the decrement d is set to different values for three ranges of conveyance speed, that is, 0.75 for a conveyance speed of 100 mm/sec, 1 for a conveyance speed of 200 mm/sec, and 1.25 for a conveyance speed of 300 mm/sec, respectively. The decrement d is set to 0.25 for all the three values of conveyance speed.

Figures 15A, 15B, 15C:
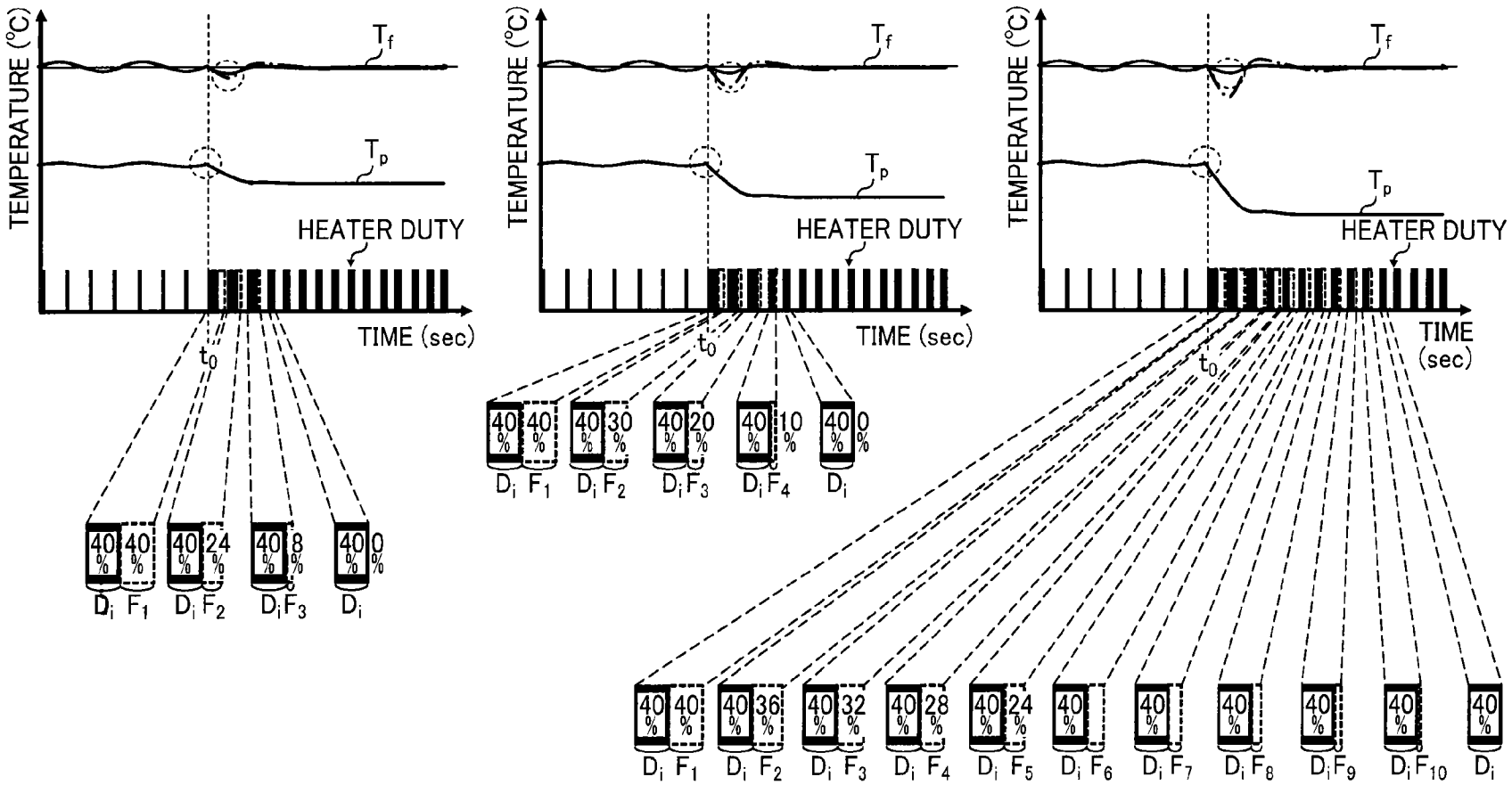
FIGS. 15A through 15C each presents graphs showing the temperature of the fuser member and the temperature of the pressure member, both in degrees Celsius (° C.), varying with time, in seconds, observed where the correction factor is adjusted for different time ratios.

FIGS. 15A through 15C each presents graphs showing the temperature Tf of the fuser member 3 and the temperature Tp of the pressure member 2, both in degrees Celsius (° C.), varying with time, in seconds, obtained where the correction factor is adjusted for different time ratios T1/(T1+T2) of 0.68, 0.75, and 0.81, respectively.

As shown in FIGS. 15A through 15C, the amount by which the temperature Tp of the pressure member 2 decreases upon initial passage of the recording sheet S through the fixing nip N at time t0 varies depending on the time ratio T1/(T1+T2), or on the sheet length L where the interval distance l and the conveyance speed V are both fixed constant, as the amount of heat absorbed by the recording sheet S from the pressure member 2 changes with the rate at which the recording sheet S exists within the fixing nip N. Without any adjustment to the duty ratio, the temperature Tf of the fuser member 3 would decrease along with the temperature Tp of the pressure member 2, as indicated by broken lines in the graphs.

In such cases, the controller 10 adjusts the correction factor F by decreasing the decrement d with increased values of the time ratio T1/(T1+T2), while keeping the initial amplification rate r constant. Such adjustment reduces the risk of overshoot in the temperature Tf, which would occur in a configuration where the decrement d decreases, instead of increases, with a decreasing sheet length T1 and an increasing interval distance T2.

In the present embodiment, for the time ratio T1/(T1+T2) of 0.68, the initial amplification rate r is set to 1, and the decrement d is set to 0.4 (FIG. 15A). For the time ratio T1/(T1+T2) of 0.75, the initial amplification rate r is set to 1, and the decrement d is set to 0.25 (FIG. 15B). For the time ratio T1/(T1+T2) of 0.81, the initial amplification rate r is set to 1, and the decrement d is set to 0.1 (FIG. 15C).

In further embodiments, instead of a single variable parameter, the controller 10 may adjust the correction factor F to be added to the duty ratio Di depending on a combination of at least two of the weight of the recording sheet S, the temperature of the recording sheet S, the conveyance speed V at which the recording sheet S is conveyed, and the ratio of the sheet passage time T1 relative to a sum of the sheet passage time T1 and the interval time T2.

Hence, the fixing device 20 according to this patent specification can effectively prevent variations in fixing performance due to a reduction in the temperature of the pressure member, owing to provision of the heating controller 10 that corrects a duty ratio, being a ratio of the on-time relative to a sum of the on-time and the off-time, by adding an adjustable, gradually decreasing positive correction factor to the duty ratio, so as to compensate for a change in the temperature of the pressure member upon initial passage of the recording medium through the fixing nip after an extended period of non-operation.

Although a particular configuration has been illustrated, the fixing device 20 may be configured otherwise than that depicted primarily with reference to FIG. 2, with appropriate modifications to the material, number, size, shape, position, and other features of components included in the fixing device. In each of those alternative embodiments, various beneficial effects may be obtained owing to the heating control according to this patent specification.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotatable fuser member subjected to heating;

a rotatable pressure member disposed opposite the fuser member, the pressure member pressing against the fuser member to form a fixing nip therebetween, through which multiple recording media, each spaced apart from each other by an interval distance in a conveyance direction, are sequentially conveyed at a conveyance speed;

a heater adjacent to the fuser member to heat the fuser member; and a controller operatively connected to the heater to control power supply to the heater through a series of on-off switching control cycles, each including an on-time during which the heater power supply is on, and an off-time during which the heater power supply is off, in synchronization with conveyance of the recording medium to satisfy the following equation:

$$T1+T2=C*X$$

where "T1" is a length of media passage time during which each recording medium passes through the fixing nip, "T2" is a length of interval time between two successive recording media exiting and subsequently entering the fixing nip, "C" is a duration of the control cycle of the heater power supply, and "X" is a cycle count being a positive integer, wherein the controller corrects a duty ratio, being a ratio of the on-time relative to a sum of the on-time and the off-time, by adding a positive correction factor decreasing with an increasing number of control cycles performed to the duty ratio, the correction factor being adjustable depending on a variable parameter with which printing is performed.

2. The fixing device according to claim 1, wherein the variable parameter comprises a weight of the recording medium.

3. The fixing device according to claim 1, wherein the variable parameter comprises a temperature of the recording medium.

4. The fixing device according to claim 1, wherein the variable parameter comprises the conveyance speed at which the recording medium is conveyed.

5. The fixing device according to claim 1, wherein the variable parameter comprises a ratio of the media passage time relative to a sum of the media passage time and the interval time.

6. The fixing device according to claim 1, wherein the variable parameter comprises a combination of at least two of a weight of the recording medium, a temperature of the recording medium, the conveyance speed at which the recording medium is conveyed, and a ratio of the media passage time relative to a sum of the media passage time and the interval time.

7. The fixing device according to claim 1, wherein the controller adjusts a rate at which the correction factor decreases depending on a ratio of the media passage time relative to a sum of the media passage time and the interval time.

8. The fixing device according to claim 1, wherein the correction factor reaches zero concurrently with the temperature of the pressure member stops decreasing since initial passage of the recording medium through the fixing nip.

9. The fixing device according to claim 1, wherein the controller performs correction to the duty ratio in a condition in which a temperature of the pressure member equals or exceeds a threshold temperature.

10. The fixing device according to claim 1, wherein the controller adjusts at least one of the conveyance speed, the interval distance, the cycle duration, the cycle count, and combinations thereof to keep the equation satisfied.

11. The fixing device according to claim 10, wherein the controller performs adjustment depending on a size of the recording medium in the conveyance direction, the media size being selected from the group consisting of a long edge of A4 size, a short edge of A4 size, a long edge of A3 size, a short edge of A3 size, a long edge of letter size, and a short edge of letter size.

12. The fixing device according to claim 1, wherein each recording sheet enters the fixing nip simultaneously with the heater being activated.

13. The fixing device according to claim 1, wherein the heater remains deactivated during the interval time between two successive recording media exiting and subsequently entering the fixing nip.

14. The fixing device according to claim 1, further including:

a first thermometer adjacent to the fuser member to measure a temperature of the fuser member; and a second thermometer adjacent to the pressure member to measure a temperature of the pressure member, wherein the controller controls power supply to the heater according to the temperature measured by at least one of the first and second thermometers.

15. An image forming apparatus incorporating the fixing device according to claim 1.

16. A fixing device comprising:

a pair of rotatable fixing members pressing against each other to form a fixing nip therebetween, through which multiple recording media are sequentially conveyed;

a heater adjacent to at least one of the fuser members to heat the fuser member; and a controller operatively connected to the heater to control power supply to the heater through a series of on-off switching control cycles, each including an on-time during which the heater power supply is on, and an off-time during which the heater power supply is off, in synchronization with conveyance of the recording medium, such that a time interval between two successive recording media entering the fixing nip equals an integer multiple of a duration of one control cycle, wherein the controller corrects a duty ratio, being a ratio of the on-time relative to a sum of the on-time and the off-time, by adding an adjustable, gradually decreasing positive correction factor to the duty ratio.

* * * * *